US005878671A

United States Patent [19]

Kehl

[11] Patent Number: 5,878,671

[45] Date of Patent: Mar. 9, 1999

[54] NOVELTY CAKE STAND DEVICE

[76] Inventor: Cynthia Kehl, 204 Anderson La., Ambler, Pa. 19002

[21] Appl. No.: 65,304

[22] Filed: Apr. 23, 1998

[51] Int. Cl.[6] ..... A47B 85/00

[52] U.S. Cl. ..... 108/22; 211/163

[58] Field of Search ..... 108/22, 21, 20, 108/94; 211/1.54, 1.57, 1.53, 41.2, 129.1, 131.1, 144, 163

[56] References Cited

U.S. PATENT DOCUMENTS

| | | | |
|---|---|---|---|
| 385,755 | 7/1888 | Haynes | 108/22 |
| 1,263,211 | 4/1918 | Conrad | 108/20 X |
| 1,468,247 | 9/1923 | Patten | 108/21 |
| 2,209,858 | 7/1940 | Steiert | 108/21 X |
| 2,324,343 | 7/1943 | Wharton | 108/22 X |
| 2,407,747 | 9/1946 | Sanderson | 108/21 |
| 4,191,437 | 3/1980 | Funke . | |
| 5,024,168 | 6/1991 | Stravitz . | |
| 5,152,099 | 10/1992 | Nilssen | 108/21 X |
| 5,479,867 | 1/1996 | Blevins et al. . | |
| 5,572,936 | 11/1996 | Chroniger . | |

FOREIGN PATENT DOCUMENTS

| | | | |
|---|---|---|---|
| 237727 | 8/1925 | United Kingdom | 108/22 |

*Primary Examiner*—Jose V. Chen
*Attorney, Agent, or Firm*—Henderson & Sturm

[57] ABSTRACT

A novelty cake stand device 10 including a base member 20 and a cake support member 30 defining a peripheral opening 50 around the device 10 wherein the opening 50 is dimensioned to receive a portion of an elongated support arm 41 having one end attached to a figurine member 40 and the other end rotatably disposed within the base member 20 such that the figurine member 40 is disposed in an orbiting relationship to the base member 20 and/or the cake support member 30 to provide an amusing appearance to the device 10.

10 Claims, 1 Drawing Sheet

NOVELTY CAKE STAND DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of rotatable supports in general, and in particular to a cake stand having a rotatable novelty component.

2. Description of Related Art

As can be seen by reference to the following U.S. Pat. Nos. 4,191,437; 5,024,168; 5,479,867; and 5,572,936, the prior art is replete with myriad and diverse support devices having a rotatable component.

While all of the aforementioned prior art constructions are more than adequate for the basic purpose and function for which they have been specifically designed, they are uniformly deficient with respect to their failure to provide a simple, efficient, and unique way to design a cake stand having an orbiting novelty component that circles the base of the cake support stand.

As most parents and pet owners are aware, it is very difficult, if not impossible, to find a new and unique way to present a cake or other celebratory confectionery foodstuff on special anniversaries such as birthdays or the like.

As a consequence of the foregoing situation, there has existed a longstanding need for a new and improved cake stand having a rotatable novelty component disposed in an orbiting relationship to the base of the cake stand, and the provision of such a construction is a stated objective of the present invention.

BRIEF SUMMARY OF THE INVENTION

Briefly stated, the novelty cake stand device that forms the basis of this invention comprises in general, a base unit, a cake support unit, and a novelty unit disposed in an orbiting relationship relative to the cake support unit and the base unit.

As will be explained in greater detail further on in the specification, the cake support unit is provided with a central support column that is operatively associated with a central column element in the base member of the base unit.

In addition, the central column element is provided with a neck portion dimensioned to receive a main gear designed to rotate within the base member. An elongated support arm is operatively associated with the main gear and provided with a figurine member that is disposed in an orbiting relationship relative to the exterior of the cake stand device to produce an aesthetically pleasing appearance to the device.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
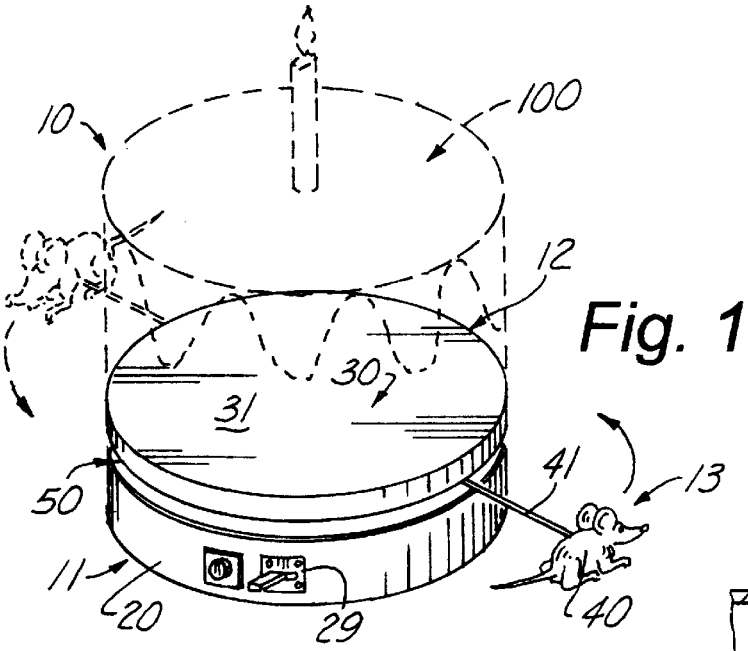
FIG. 1 is a perspective view of the novelty cake stand that forms the basis of the present invention.

As can be seen by reference to the drawings, and in particularly to FIG. 1, the novelty cake stand that forms the basis of the present invention is designated generally by the reference number 10. The cake stand 10 comprises in general, a base unit 11, a cake support unit 12, and a novelty unit 13. These units will now be described in seriatim fashion.

Figure 3:
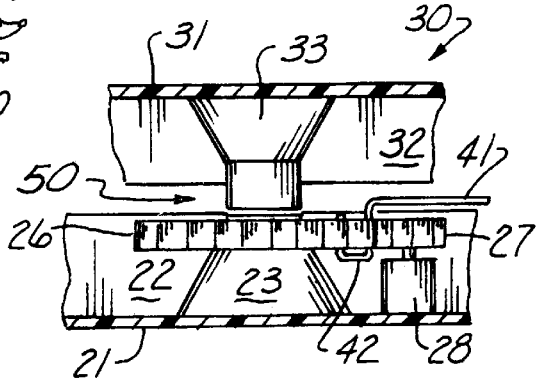
FIG. 3 is an isolated detail view of the operative engagement between the cake support unit and the base unit.
Figure 2:
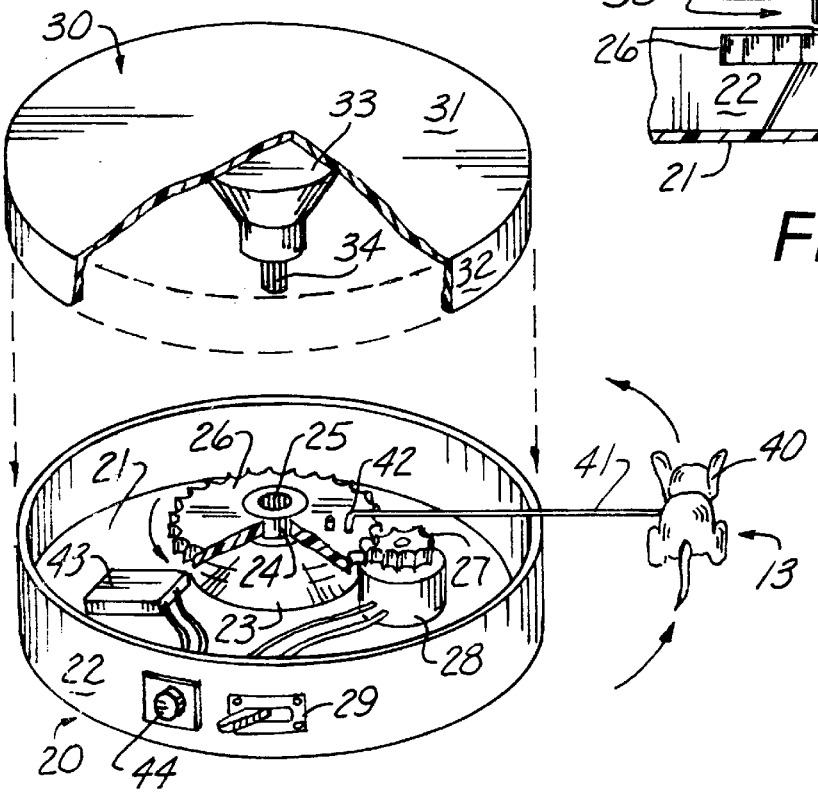
FIG. 2 is an exploded perspective view of the novelty cake stand.

As can best be seen by reference to FIGS. 2 and 3, the base unit 11 comprises a generally truncated cylindrical base member 20 having a floor 21 surrounded by a raised sidewall 22.

In addition, a tapered column element 23 is centrally disposed on the floor 21 of the base member 20 and provided with a hollow elongated neck portion 24 provided with a central opening 25 wherein the neck portion 24 is operatively associated with a main gear 26.

Furthermore, the main gear 26 is operatively engaged with a driving gear 27 rotatably mounted on a drive motor 28 connected to an on-off switch 29 disposed in the sidewall 22 of the base member 20.

As shown in FIGS. 1 through 3, the cake support unit 12 comprises a cake support member 30 having a flat circular top 31 and a downwardly depending skirt portion 32.

Furthermore, a downwardly depending tapered support column 33 is centrally disposed underneath the top 31 of the cake support member 30 and further provided with a support post 34 which is dimensioned to be received in the central opening 25 in the neck portion 24 of the base member column element 23.

As can also be seen by reference to FIGS. 1 and 2, the engagement between the cake support member 30 and the base member 20 creates a peripheral opening 50 which encircles the device 10 and which is dimensioned to receive a portion of the novelty unit 13 as will be explained presently.

As can best be seen by reference to FIGS. 2 and 3, the novelty unit 13 comprises a figurine novelty member 40 mounted on one end of an elongated support arm 41 having a hooked portion 42 formed on its other end which is operatively connected to the main gear 26 to allow the novelty member 50 to orbit around the periphery of the base member 20 and the cake support member 30 as the elongated support arm 41 passes through the peripheral opening 50.

In addition, as shown in FIG. 2, the novelty unit 13 also comprises an audio generating member 43 capable of producing music, animal sounds, or the like and provided with a push button actuator 44 which extends through the sidewall 22 of the base member 20.

In the preferred embodiment of the invention, the main gear 26 is rotatably attached to the neck portion 24 of the column element 23 in the base member 20 such that the base member 20 and cake support member 30 are disposed in a stationary relationship relative to one another.

However, in an alternate version of the preferred embodiment depicted in FIG. 2, the main gear 26 is fixedly secured to the neck portion 24 of the column element 23. The neck portion 24 is rotatably associated with the remainder of the column element 23.

Furthermore, the interior of the central opening 25 of the neck portion 24 of the column element 23 is knurled as is the downwardly depending post 34 of the support column 33 of the cake support member 30 such that both the figurine member 40 and the cake support member 30 are rotatably disposed relative to the stationary base member 20.

It should further be noted that the figurine member 40 resembles a mouse in FIG. 1 that appears to run around the base member 20. This invention also contemplates the use of a contoured support arm 41 (not shown) that would support a bee or bird shaped figurine member 40 that would appear to circle the cake 100 at a height disposed about the top 31 of the cake support member 30.

In addition, while only one support arm 41 and one figurine member 40 are shown in an orbiting relationship relative to the device 10, it should be appreciated that a plurality of support arms 41 and figurine members 40 could be employed such as a cat and mouse, a cowboy and Indian, or other common pairings.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A novelty cake stand device comprising a cake support unit including a generally cylindrical cake support member provided with a flat top and a downwardly depending central support column;

a base unit including a generally truncated cylindrical base member provided with a centrally disposed column element having a rotatable portion wherein the column element is operatively connected to the central support column of the cake support member to create a peripheral opening between the cake support member and the base member; and a novelty unit including a novelty member disposed on one end of an elongated support arm having an intermediate portion which passes through said peripheral opening and the other end of the support arm connected to the rotatable portion of the column element.

2. The device as in claim 1 wherein the rotatable portion of the column element comprises a neck portion having a main gear that is operatively associated with said other end of the elongated support arm.

3. The device as in claim 2 wherein the base member is also provided with a driving gear engaged with the periphery of the main gear and provided with a drive motor for imparting rotary motion to said driving gear and said main gear.

4. The device as in claim 3 wherein neck portion of the column element is provided with a central opening and the support column of the cake support unit is provided with a support post dimensioned to be received in said central opening.

5. The device as in claim 4 wherein said main gear is rotatably disposed on the neck portion of the column element.

6. The device as in claim 4 wherein said main gear is fixedly disposed on the neck portion of the the column element and the neck portion is rotatably disposed relative to the remainder of the column element.

7. The device as in claim 4 wherein said support post is rotatably disposed within said central opening.

8. The device as in claim 4 wherein said support post is fixedly secured within said central opening.

9. The device as in claim 1 wherein the novelty unit also includes an audio generating member disposed within the base member.

10. The device as in claim 1 wherein the elongated support arm is contoured to suspend the figurine member at a height spaced from and above the cake support member.

* * * * *